US005681159A

United States Patent [19]

Benedek et al.

[11] Patent Number: 5,681,159

[45] Date of Patent: Oct. 28, 1997

[54] PROCESS AND APPARATUS FOR LOW $NO_x$ STAGED-AIR COMBUSTION

[75] Inventors: Karen R. Benedek, Winchester, Mass.; Charles E. Benson, Windham, N.H.; Philip C. Carbone, Groveland, Mass.

[73] Assignee: Gas Research Institute, Chicago, Ill.

[21] Appl. No.: 625,926

[22] Filed: Apr. 1, 1996

Related U.S. Application Data

[63] Continuation of Ser. No. 212,177, Mar. 11, 1994.

[51] Int. Cl.[6] ..... F23M 3/00

[52] U.S. Cl. ..... 431/9; 431/8; 431/354; 126/116 R; 126/91 A; 126/115; 126/350

[58] Field of Search ..... 126/91 A, 16 R; 431/8, 9, 10, 115, 190, 350, 354, 181, 187, 159

[56] References Cited

U.S. PATENT DOCUMENTS

| | | | |
|---|---|---|---|
| 2,333,531 | 12/1943 | Ferguson . | |
| 2,582,577 | 1/1952 | Zink et al. . | |
| 3,782,887 | 1/1974 | Brown | 431/353 |
| 3,820,320 | 6/1974 | Schirmer et al. . | |
| 3,826,077 | 7/1974 | Quigg et al. . | |
| 3,826,079 | 7/1974 | Quigg et al. . | |
| 3,828,762 | 8/1974 | Duzey | 126/91 A |
| 4,004,875 | 1/1977 | Zink et al. | 431/9 |
| 4,181,491 | 1/1980 | Hovis | 431/190 X |
| 4,331,638 | 5/1982 | Michelfelder | 431/10 |
| 4,357,134 | 11/1982 | Katsushige et al. . | |
| 4,457,704 | 7/1984 | Sommers et al. | 431/353 X |
| 4,511,325 | 4/1985 | Voorheis . | |
| 4,531,904 | 7/1985 | Sato et al. . | |
| 4,610,625 | 9/1986 | Bunn . | |
| 4,629,413 | 12/1986 | Michelson et al. | 431/10 X |
| 4,702,691 | 10/1987 | Ogden | 431/354 X |
| 4,776,320 | 10/1988 | Ripka et al. | 126/116 R X |
| 4,784,600 | 11/1988 | Moreno . | |
| 5,244,381 | 9/1993 | Cahlik | 126/116 R X |

FOREIGN PATENT DOCUMENTS

| | | | |
|---|---|---|---|
| 53-111531 | 9/1978 | Japan . | |
| 126527 | 11/1978 | Japan | 431/354 |
| 0102822 | 8/1980 | Japan | 431/164 |
| 57-31711 | 2/1982 | Japan . | |
| 57-60107 | 4/1982 | Japan . | |
| 6174207 | 6/1994 | Japan | 431/190 |
| 2048456 | 12/1980 | United Kingdom . | |

*Primary Examiner*—Carl D. Price

*Attorney, Agent, or Firm*—Speckman, Pauley & Fejer

[57] ABSTRACT

A process and apparatus for combustion of fuel which results in reduction of nitrogen oxides and carbon monoxides emissions. Fuel and primary air are preferably premixed and introduced into a combustion chamber. Secondary air is introduced through a plurality of secondary air ports which are positioned about a venturi nozzle or flame holder disk mounted with respect to a combustion chamber wall. The secondary air flowing through the secondary air ports forms relatively high velocity and momentum secondary air jets that promote rapid mixing of the fuel and primary air mixture into the secondary air flow, such that a combustion flame is established at a periphery of the secondary air jets.

9 Claims, 4 Drawing Sheets

PROCESS AND APPARATUS FOR LOW $NO_X$ STAGED-AIR COMBUSTION

This application is a continuation of copending application Ser. No. 08/212,177 filed on 11 Mar. 1994.

BACKGROUND OF THE INVENTION

1. Field of the Invention

This invention relates to a process and apparatus for reducing the emission of nitrogen oxides and carbon monoxide, particularly in furnaces or heaters fired with natural gas, wherein secondary air is introduced into a combustion chamber by forming a plurality of relatively high velocity secondary air jets that promote rapid mixing of a fuel and primary air mixture into the secondary air flow.

2. Description of Prior Art

U.S. Pat. No. 4,511,325 discloses a burner for reducing nitrogen oxides ($NO_x$) emissions. Make-up air is introduced through delivery ports which are laterally spaced from a fuel injection nozzle and a main air opening. The make-up air is introduced through the air delivery ports at a sufficient pressure so that the air penetrates deep into the combustion chamber.

U.S. Pat. No. 4,601,625 teaches a gas burner having axially directed jet members positioned in an opening within a firewall. Fuel and air are premixed and then injected into a combustion chamber through tubular jets that extend into the combustion chamber. Secondary combustion air is introduced into the combustion chamber through secondary air jets that each have a discharge end directed at an angle to create a swirling secondary air flow within the combustion chamber.

U.S. Pat. No. 4,629,413 discloses a burner which uses secondary air to reduce $NO_x$ emissions. Secondary air ports are positioned about the nozzle and are used to introduce secondary air into the combustion chamber.

U.S. Pat. No. 4,531,904 teaches fuel gas nozzles which inject fuel into combustion air flowing through an annular passage.

The combustion of fossil fuels results in the emission of pollutants to the environment, including oxides of nitrogen (NO and $NO_2$) and carbon monoxide (CO). The exhaust gases of natural-gas-fired furnaces and heaters for residential or commercial applications typically contain $NO_x$ concentrations of 60–120 parts per million (dry, corrected to 3% $O_2$) and CO concentrations of 5–20 ppm (dry, at 0% $O_2$). It is desirable to reduce the emissions of $NO_x$ from furnaces and heaters at standard operating conditions without significantly increasing the emissions of CO from these devices.

The firing density of furnace heat exchangers can be limited by the point at which the CO emissions increase beyond acceptable levels. This is called the "sour point" of the furnace. For safety purposes, it is desirable to have a sour point at a firing density well above the operating point of the furnace. Alternatively, a combustion system that allows the sour point to be moved to higher firing rates, and therefore extend the operating range of the furnace, is desirable.

SUMMARY OF THE INVENTION

It is one object of this invention to provide a process and apparatus for reducing $NO_x$ and CO emissions by creating high velocity secondary air jets that promote rapid mixing of the fuel and primary air mixture into the secondary air flow.

It is another object of this invention to provide a process and apparatus wherein the secondary air jets draw a combustion flame outward toward a periphery of such secondary air jets and anchor the combustion flame about such periphery.

The above and other objects of this invention are accomplished with a process of combustion wherein fuel and primary air are preferably premixed within a venturi nozzle and injected into a combustion chamber. The fuel and primary air mixture preferably passes through a flame holder disk which is used to locate and control the velocity of the fuel and primary air mixture within the combustion chamber. Secondary air is introduced through a plurality of secondary air ports positioned within a combustion chamber wall or a suitable structure fixed with respect to the combustion chamber wall, and positioned about or around the flame holder disk. Secondary air is introduced through such secondary air ports so that a plurality of high velocity secondary air jets are created for promoting rapid mixing of the fuel and primary air mixture into the secondary air flow, so that the combustion flame is anchored at the periphery of the secondary air jets.

As the secondary air passes through the secondary air ports, the secondary air flow entrains combustion products within the combustion chamber in an upstream direction, with respect to downstream discharge direction 27, as shown in FIG. 5, that the combustion products flow through the combustion chamber. In one preferred embodiment according to this invention, the entrained combustion products effectively suppress an operating temperature of combustion flame, particularly at the anchoring position of the combustion flame, near the periphery of each of the secondary air jets.

The secondary air jets have a relatively high velocity, with respect to the velocity of the fuel and primary air. In one preferred embodiment according to this invention, the momentum of the fuel and primary air mixture is approximately 30%–40% of the momentum of each secondary air jet. However, the fuel and primary air mixture preferably flows at least at a rate which is sufficient to prevent flashback of the fuel and primary air mixture.

The secondary air ports and the flow of secondary air through the ports are preferably designed to prevent the combustion flame from an anchoring at or on an edge of a suitable structure defining the secondary air ports.

In one preferred embodiment according to this invention, the fuel and primary air mixture is fuel enriched beyond a rich flammability limit of the fuel. For example, with natural gas, the fuel and primary air mixture can have an equivalence ratio of fuel to primary air in a range of approximately 1.7–2.5. The burner of this invention can also operate with a fuel and primary air equivalence ratio as low as about 1.4.

The secondary air preferably flows through secondary air ports that each have a swaged inlet section, in order to achieve the relatively high velocity of the secondary air jets at an acceptable pressure drop. The swaged secondary air ports are an important aspect of this invention, particularly for creating the high velocity, narrow angle, secondary air jets that are necessary for reducing the undesirable emissions and establishing a stable flame.

BRIEF DESCRIPTION OF DRAWINGS

The above-mentioned and other features and objects of this invention will be better understood from the following detailed description taken in conjunction with the drawings wherein.

DESCRIPTION OF PREFERRED EMBODIMENTS

Figure 1A:
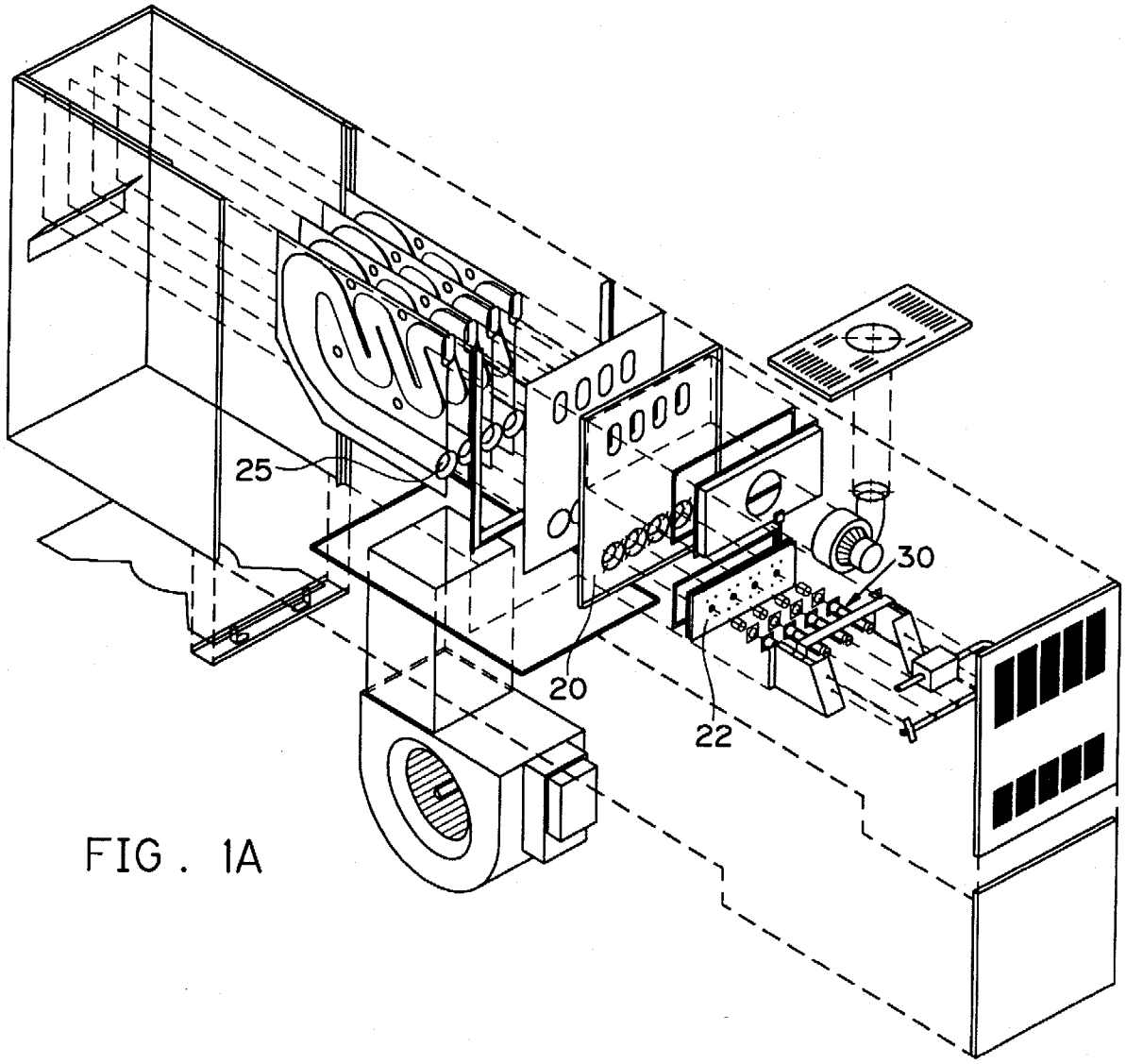
FIG. 1A is an exploded perspective view of a furnace showing four burners, each having a venturi nozzle, according to one preferred embodiment of this invention.
Figure 5:
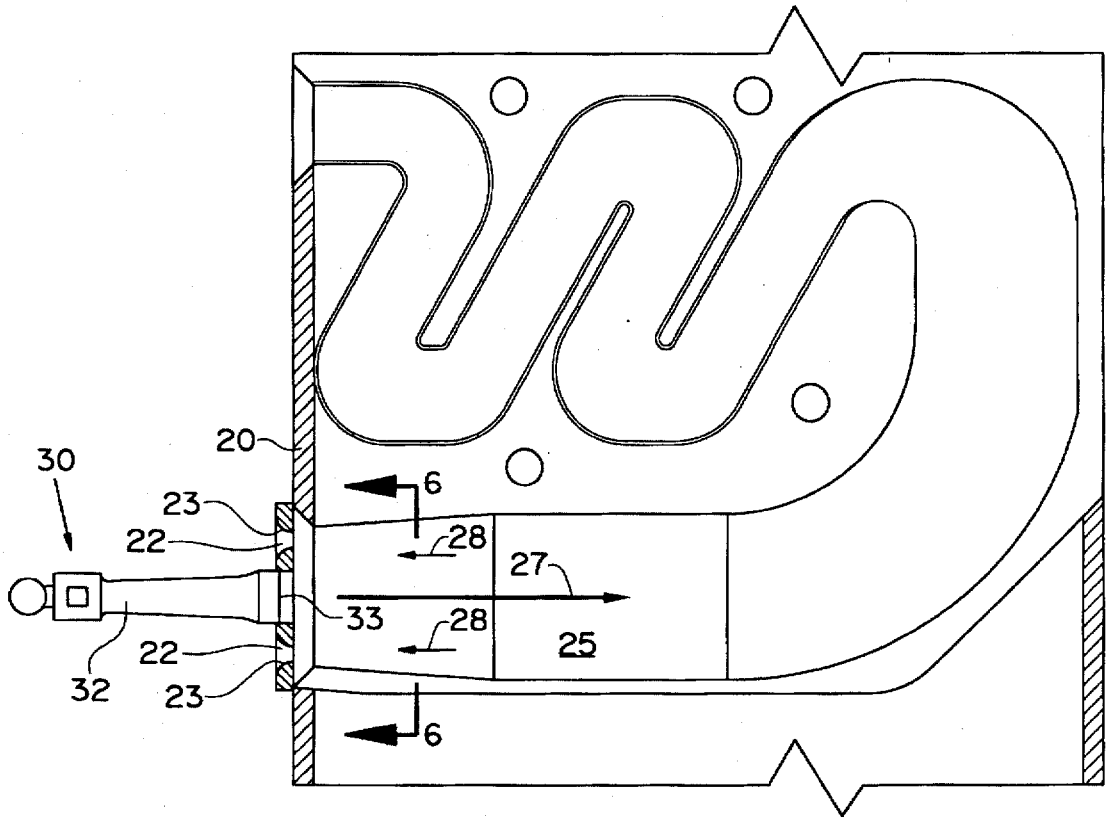
FIG. 5 is a cross-sectional diagrammatic view of a venturi nozzle and a flame holder disk mounted with respect to a furnace wall, according to one preferred embodiment of this invention.
Figure 4:
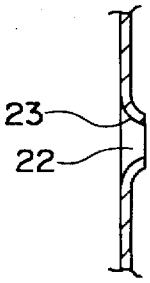
FIG. 4 is a partial cross-sectional view of a wall having a swaged secondary air port, according to one preferred embodiment of this invention.

FIG. 1A shows an exploded perspective view of a furnace having four independent combustion chambers 25, each associated with one venturi nozzle 32. FIG. 5 is a cross-sectional diagrammatic view of one combustion chamber 25, as shown in FIG. 1. FIG. 4 is a partial cross-sectional view showing combustion chamber wall 20 or another suitable wall or structure having swaged secondary air port 23, which is a very important aspect in one preferred embodiment of this invention.

In a preferred process of combustion, according to this invention, fuel and primary air are introduced into combustion chamber 25. Preferably, the fuel and primary air are premixed within venturi nozzle 32, before being introduced into combustion chamber 25. The fuel and primary air mixture preferably pass through flame holder disk 52 prior to being introduced into combustion chamber 25. However, it is apparent that other suitable means can be used to introduce the fuel and primary air mixture into combustion chamber 25.

Figure 6:
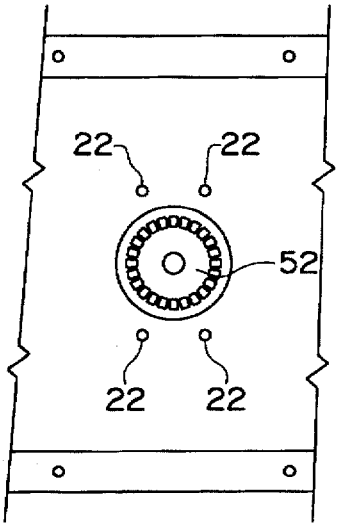
FIG. 6 is a rear view of the discharge end of the venturi nozzle and the flame holder disk mounted with respect to a combustion chamber wall, taken along line 6—6, according to the preferred embodiment of this invention shown in FIG. 5.

In one preferred embodiment according to this invention, secondary air is introduced through a plurality of secondary air ports 22 which are positioned about flame holder disk 52, for example as shown in FIG. 6. Secondary air ports 22 are preferably formed into a sheet metal wall, for example, of combustion chamber 25. However, it is apparent that the secondary air can be introduced through other secondary air ports 22 which are within a plate or other structural member secured either directly to or with respect to combustion chamber wall 20, or can even be introduced through secondary air inlet tubes.

Figure 8:
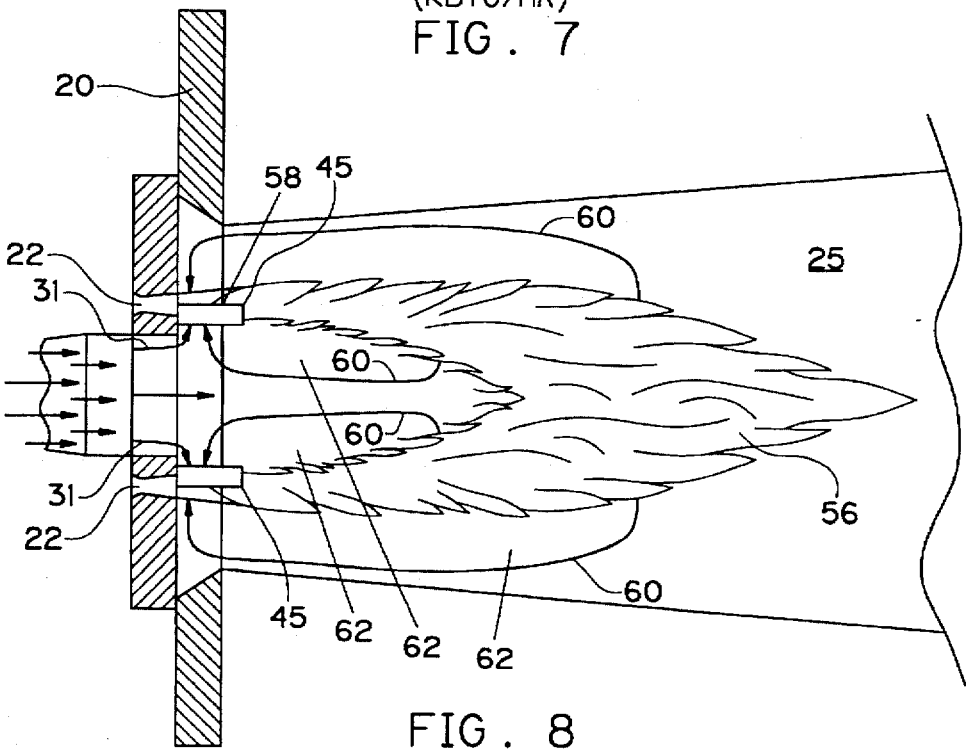
FIG. 8 is a diagrammatic view showing a general shape of a combustion flame and a region of flame stabilization, according to one preferred process of this invention.

As the secondary air passes through secondary air port 22 or secondary air inlet tubes 23, a plurality of relatively high velocity and high momentum secondary air jets 45 are formed, as shown in FIG. 8. Such secondary air jets 45 promote rapid mixing of the fuel and primary air mixture into the secondary air flow, such that a combustion flame is established or anchored at a periphery of secondary air jets 45. FIG. 8 shows a diagrammatic view of combustion flame 56 and the associated flame stabilization region 58 established near secondary air jets 45.

As used throughout this specification and in the claims, the terms "air" and "oxidant" are intended to be interchangeable. It is apparent that the process of combustion according to this invention can operate with air, oxygen-enriched air, oxygen or any other suitable oxidant. The term "fuel" as used throughout this specification and in the claims relates to any suitable gaseous fuel, atomized fuel, gasified or any other suitable type of fuel. Natural gas and other gaseous fuel are preferred for operation with the low $NO_x$ combustion process according to this invention.

The relatively high velocity and momentum of secondary air jets 45 tends to entrain combustion products from downstream of the combustion flame, in upstream direction 28 within combustion chamber 25, as shown in FIG. 5. In one preferred embodiment according to this invention, the momentum of primary flow of the fuel and to primary mixture is approximately 30% to approximately 40% of the momentum of secondary flow of each secondary air jet 45. Also, the fuel and primary air preferably flow at a minimum rate or with a minimum flow momentum which is sufficient to prevent flashback of the fuel and primary air mixture and to maintain flame stability.

The high velocity of secondary air jets 45 entrain the combustion products in a manner that suppresses the operating temperature of the combustion flame, particularly where the combustion flame is anchored about the periphery of secondary air jets 45. The entrained combustion products are generally directed towards secondary air jets 45, as indicated by arrows 60 in FIG. 8. Each secondary air jet 45 is preferably sized to prevent the combustion flame from anchoring at combustion chamber wall 20, or any other suitable structure, about each secondary air port 22.

In one preferred embodiment according to this invention, the fuel and primary air mixture is fuel enriched beyond a rich flammability limit of the fuel. Thus, in such preferred embodiment, the fuel and primary air mixture is so rich that the fuel and primary air mixture cannot burn alone. It is therefore important for the fuel and primary air mixture to move toward secondary air jets 45, as indicated by arrows 31 in FIG. 8, so that the fuel can combust in a fashion that forms or establishes the combustion flame about the periphery of secondary air jets 45. In the case of a natural gas burner, the fuel and primary air mixture preferably has an equivalence ratio of fuel to primary air in a range of approximately 1.7 to approximately 2.5.

Experiments conducted according to the process and apparatus of this invention prove that passing the secondary air through swaged inlet 23 of secondary air port 22, as clearly shown in FIG. 4, results in significantly improved combustion results, such as greatly improved flame stability and higher levels of excess air.

Figure 1B:
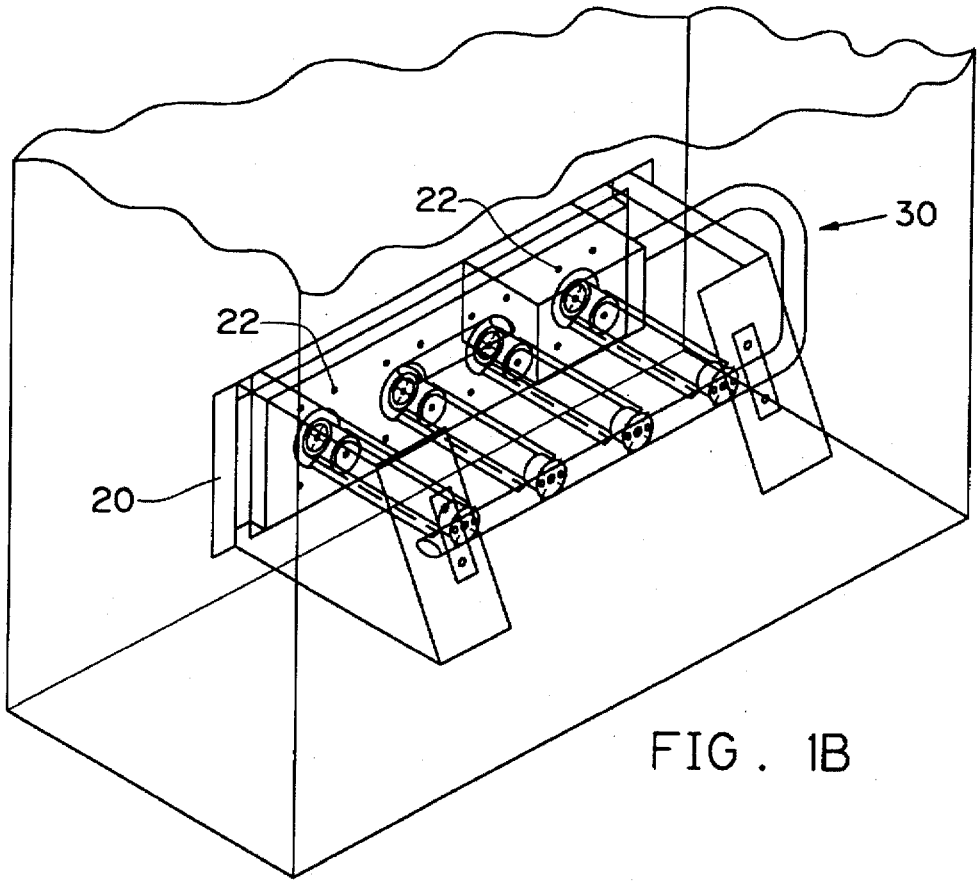
FIG. 1B is a perspective view of the four burners and a manifold mounted with respect to a wall of a furnace.
Figure 2:
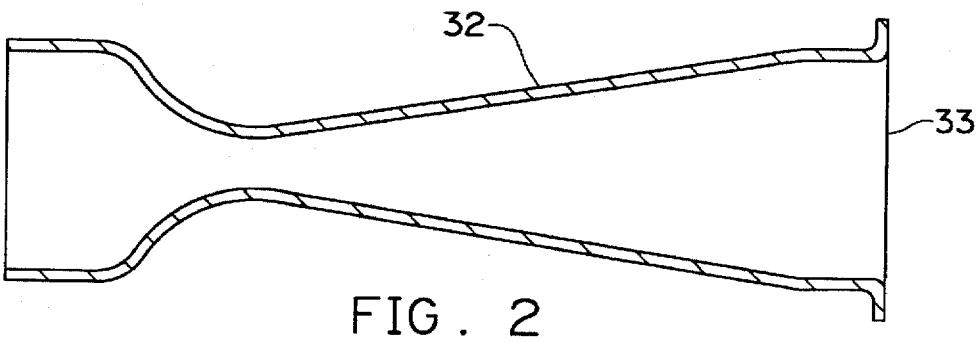
FIG. 2 is a cross-sectional view of a venturi nozzle, according to one preferred embodiment of this invention.
Figure 3A:
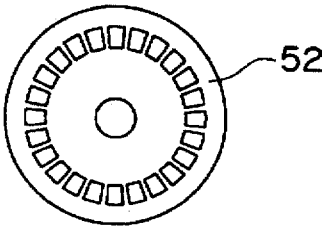
FIG. 3A is a front view of a flame holder disk, according to one preferred embodiment of this invention.
Figure 3B:
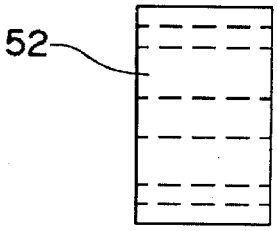
FIG. 3B is a side view of the flame holder disk shown in FIG. 3A.

The apparatus of this invention preferably comprises at least one combustion chamber wall 20 which forms sealed combustion chamber 25, as shown in FIG. 5. Flame holder disk 52, as shown in FIGS. 3A and 3B, is preferably mounted within discharge end 33 of venturi nozzle 32. When venturi nozzle 32 is mounted with respect to combustion chamber wall 20, as shown in FIGS. 1B and 6, the fuel and primary air pass through primary air ports 55 within flame holder disk 52. Discharge end 33 of venturi nozzle is preferably sealed and secured with respect to combustion chamber wall 20.

Primary means 30 are used to form the fuel and primary air mixture, and to introduce the fuel and primary air mixture into combustion chamber 25. In one preferred embodiment according to this invention, such primary means comprise venturi nozzle 32 and/or flame holder disk 52. It is apparent that venturi nozzle 32 and flame holder disk 52 can be designed in various manners to produce different sizes, shapes and types of flames.

Secondary air inlet means are used to introduce the secondary air into combustion chamber 25, and to form secondary air jets 45 in a suitable pattern about discharge end 33 of venturi nozzle 32. In one preferred embodiment according to this invention, such secondary air inlet means comprise combustion chamber wall 20 having a plurality of secondary air ports 22 positioned about venturi nozzle 32. FIG. 6 shows one preferred embodiment of an arrangement of secondary air ports 22 with respect to venturi nozzle 32, combustion chamber wall 20 or flame holder disk 52. However, it is apparent that more or less secondary air ports 22 can be positioned in various other patterns about venturi nozzle 32, combustion chamber wall 20 or flame holder disk 52.

It is one important aspect of this invention for each secondary air port 22 to have swaged inlet 23, as shown in FIG. 4. As previously discussed, significantly improved flame stability is achieved by using such swaged inlet 23. Swaged inlet 23 significantly increases the velocity profile and momentum of secondary air flow within combustion chamber 25, thereby drawing or entraining the combustion flame to the outer periphery of each secondary air jet 45.

In one preferred embodiment according to this invention, control means can be used to vary the fuel and primary air flow so that the momentum of the fuel and primary air flow is approximately 30% to approximately 40% of the momentum of each secondary air jet 45. Such control means may comprise a suitably sized and shaped venturi nozzle 32 and/or flame holder disk 52. It is also apparent that such control means may also comprise programmed computing means for determining suitable fuel and primary air flow conditions.

Enhanced combustion performance, such as reduced $NO_x$ and CO emissions are accomplished according to the process and apparatus of this invention, primarily due to the relatively high velocity and momentum of secondary air jets 45, a relatively high equivalence ratio of the fuel and primary air, and a strong internal recirculation or entrainment pattern which is established by secondary air jets 45. FIG. 8 illustrates recirculation zones 62 that are formed by secondary air jets 45. The relatively high velocity secondary air jets 45 cause rapid mixing of the preferably premixed fuel and primary air mixture into secondary air jets 45 and thereby establish and cool the combustion flame at the periphery of secondary air jets 45. The velocity and position of the fuel and primary air jet, which is established by the design of flame holder disk 52 and venturi nozzle 32, is critical to provide a stable flame that does not flashback, particularly in view of the strong reverse flow within combustion chamber 25, as established by secondary air jets 45.

According to the process of this invention, the combustion flame does not necessarily become established at the periphery of the primary air jet, since there is insufficient air in the fuel and primary air flow for ignition and combustion to occur. Also, with natural gas, with an equivalence ratio of the fuel and primary air mixture approximately 1.7 to approximately 2.5, the fuel will not burn since such equivalence ratio is significantly higher than the upper flammability limit for natural gas, for example, which is approximately 1.7.

Secondary air jets 45 establish an internal combustion product recirculation pattern that is very important to the performance of the process, since the combustion products reduce the oxygen concentration in secondary air jets 45 and also suppress the combustion flame temperature, thereby reducing $NO_x$ formation, CO formation, and burner noise.

Figure 7:
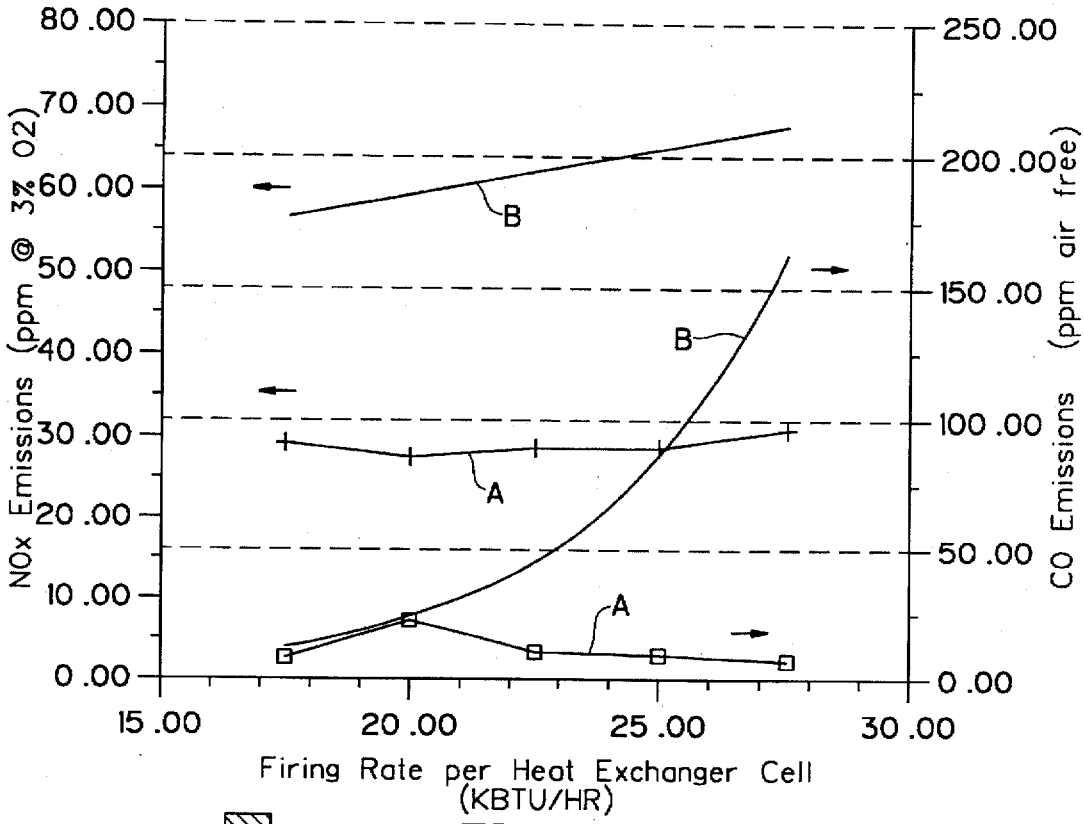
FIG. 7 is a graph of experimental results showing a comparison, of oxides of nitrogen emissions and carbon monoxide emissions as a function of a firing rate per heat exchanger cell, between a furnace according to the process and apparatus of this invention and a conventional furnace.

FIG. 7 shows experimental results identifying the performance of the process and apparatus tested according to this invention, compared to that of conventional burner technology. As can be seen from the graphical representation, $NO_x$ emissions are about one-half to about one-third of $NO_x$ emissions of conventional burners. According to the process and apparatus of this invention, as represented by the lines in FIG. 7 that are labelled with "A", CO emissions are significantly reduced relative to CO emissions levels from conventional burners operating at relatively high firing densities, as represented by the lines in FIG. 7 that are labelled with "B". This is a very desirable characteristic because it allows higher heat input to each heat exchanger cell of the furnace.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

What is claimed is:

1. A process of combustion for reducing nitrogen oxides and carbon monoxide emissions, the process including the steps of:

introducing a premixed fuel and primary oxidant mixture into a nozzle, having a discharge end sealed and secured with respect to a combustion chamber wall which defines a combustion chamber, in a fuel amount and a primary oxidant amount and at a nozzle discharge velocity sufficient to prevent ignition of the premixed fuel and primary oxidant mixture in a first zone of the combustion chamber;

introducing secondary oxidant through at least one secondary oxidant port positioned radially outward with respect to the nozzle and forming at least one secondary oxidant jet;

directing the at least one secondary oxidant jet for rapid mixing of the fuel and primary oxidant mixture into the secondary oxidant; and first combusting the fuel and primary oxidant mixture in a second zone, the second zone being located adjacently downstream of the first zone, and forming a stabilized combustion flame anchored at a periphery of the at least one secondary oxidant jet.

2. A process of combustion for reducing nitrogen oxides and carbon monoxide emissions, the process including the steps of:

introducing a premixed fuel and primary oxidant mixture into a first zone of a combustion chamber, there being no burning of the premixed fuel and primary oxidant mixture in the first zone;

introducing secondary oxidant into the combustion chamber to form at least one secondary oxidant jet, the at least one secondary oxidant jet drawing the premixed fuel and primary oxidant mixture in a generally radially outward direction through the first zone and into a second zone of the combustion chamber; and combusting the premixed fuel and primary oxidant mixture in the second zone to form a stabilized combustion flame anchored about a periphery of the at least one secondary oxidant jet.

3. A process according to claim 2 wherein the secondary oxidant passes through at least one secondary oxidant port positioned generally radially outward with respect to an inlet through which the premixed fuel and primary oxidant mixture is introduced, and the secondary oxidant entrains combustion products in an upstream direction with respect to a downstream discharge direction of the combustion products.

4. A process according to claim 3 wherein the entrained combustion products suppress an operating temperature of the stabilized combustion flame near a periphery of each of the at least one secondary oxidant jet.

5. A process according to claim 2 wherein a first momentum of flow of the fuel and primary oxidant mixture is approximately 30% to approximately 40% of a second momentum of flow of the secondary oxidant.

6. A process according to claim 2 wherein the fuel and primary oxidant mixture flows at a rate which is sufficient to prevent flashback of the fuel and primary oxidant mixture.

7. A process according to claim 2 wherein flow of the secondary oxidant prevents the combustion flame from anchoring at a combustion chamber wall about each of the secondary oxidant ports.

8. A process according to claim 2 wherein the combustion products are entrained in a direction towards the at least one secondary oxidant jet.

9. A process according to claim 1 wherein the fuel and primary oxidant mixture has an equivalence ratio of fuel to primary oxidant in a range of approximately 1.7 to approximately 2.5.

* * * * *